US007845498B2

(12) United States Patent
Kauffman

(10) Patent No.: US 7,845,498 B2
(45) Date of Patent: Dec. 7, 2010

(54) SEPARATION OF METALS FROM SAND

(76) Inventor: John Kauffman, 1902 E. Main, Canon City, CO (US) 81212

( * ) Notice: Subject to any disclaimer, the term of this patent is extended or adjusted under 35 U.S.C. 154(b) by 280 days.

(21) Appl. No.: 11/999,157

(22) Filed: Dec. 4, 2007

(65) Prior Publication Data

US 2009/0139910 A1 Jun. 4, 2009

(51) Int. Cl.
*B07B 13/00* (2006.01)
*B07C 5/12* (2006.01)

(52) U.S. Cl. ..... 209/687; 209/44; 209/452

(58) Field of Classification Search ..... 209/442, 209/444, 452, 687, 270, 294
See application file for complete search history.

(56) References Cited

U.S. PATENT DOCUMENTS

| | | | | | |
|---|---|---|---|---|---|
| 289,018 | A | | 11/1883 | Miller | 209/442 |
| 2,053,802 | A | * | 9/1936 | Malcolm | 209/452 |
| 2,164,364 | A | * | 7/1939 | Willner, Sr. | 209/234 |
| 2,599,402 | A | * | 6/1952 | Lindsey | 209/44 |
| 2,889,174 | A | * | 6/1959 | Wilhelm | 406/92 |
| 3,761,132 | A | | 9/1973 | Grable | 299/7 |
| 4,071,143 | A | | 1/1978 | Richan | 209/444 |
| 4,159,242 | A | * | 6/1979 | Walker | 209/44 |
| 4,168,314 | A | * | 9/1979 | Christensen et al. | 514/192 |
| 4,265,743 | A | | 5/1981 | Younge | 209/452 |
| 4,319,985 | A | | 3/1982 | Hibbard | 209/3 |
| 4,347,130 | A | | 8/1982 | Younge | 209/452 |
| 4,512,881 | A | * | 4/1985 | Shumway et al. | 209/270 |
| 4,642,180 | A | | 2/1987 | Kaufman | 209/44 |
| 4,684,314 | A | * | 8/1987 | Luth | 414/746.1 |
| 4,860,874 | A | | 8/1989 | Winderl | 193/2 B |
| 5,108,584 | A | * | 4/1992 | Brosseuk | 209/44 |
| 5,275,294 | A | | 1/1994 | Krenzler | 209/434 |
| 6,138,833 | A | * | 10/2000 | Matsufuji et al. | 209/10 |
| 7,168,568 | B2 | | 1/2007 | Wise | 209/39 |

* cited by examiner

*Primary Examiner*—Terrell H Matthews
(74) *Attorney, Agent, or Firm*—Linda Flewellen Gould

(57) ABSTRACT

The present invention provides a method and an apparatus for removing heavy metals such as gold from sand. A mixture of sand and metals is placed in a hollow tube which has an open end, an opposite closed end at a relatively lower position, an exterior, and an interior formed into spiral grooves. The grooves are arranged in a helical fashion so that metal caught in the grooves is carried toward the open end of the tube as the tube is rotated. Water is supplied to the tube to mix with the sand and metal, so that rotation of the tube causes relatively heavy metal to be washed from the sand and water mixture into the grooves. The mechanism can be transported to a location where heavy metals naturally occur in sand or other materials.

5 Claims, 7 Drawing Sheets

SEPARATION OF METALS FROM SAND

BACKGROUND OF THE INVENTION

1. Field of the Invention

The present invention relates to a method of and apparatus for separating gold or other heavy metals from sand, ore, or other materials in which those metals occur.

2. Description of the Prior Art

Historically, gold miners have used a variety of methods and devices for removing gold from ore or sand in which that gold naturally occurs. A commonly used device which has been used for more than a century is a riffle board. The riffle board has ridges which are designed to trap and retain gold, as sand in which that gold resides is washed over the board. Typically, the riffle board was placed in a stream to allow constant washing with water as sand was placed on the board by the miner. The relatively heavy metal tended to fall out of the sand and be retained in the ridges of the riffle board, as relatively lighter-weight sand was washed down the stream. Although inefficient and capable of processing only small amounts of sand at a time, the riffle board provided gainful employment for many a gold miner.

Over the course of time, other devices have been invented to separate gold from other materials. For example, U.S. Pat. No. 289,018, granted in 1883 to Miller, describes an ore concentrator which involves placing materials in a pan and subjecting that pan to a blow, so that heavier particles such as gold would advance to the point "where the blow is given", leaving other materials to be discharged.

A double sluice, over which sand and water flows first one direction and then another, is described in U.S. Pat. No. 4,319,985 to Hibbard. The device described in U.S. Pat. No. 4,860,874 to Winderl relies on vibration of a trough to concentrate ore.

A device typically known as a "California Gold Hound" is used to remove black sand from concentrate or gold from placer materials. In an example of this device taught by U.S. Pat. No. 5,275,294 to Krenzler, a separator pan having a spiral rib is set in a stream, and the pan is rotated, causing particles of gold introduced into the pan to be moved inwardly into a receptacle at the center of the pan. U.S. Pat. No. 2,053,802 to Nicol teaches a two-step process for removing minerals from black sand or similar material using a rotating drum, potentially positioned in a stream to receive water. The Nicol device has circumferential cross riffles for collecting gold and longitudinal riffles, arranged perpendicular to the cross rifles, for collecting and removing gold. A feed chute is positioned to add material into the drum at an open end, potentially disturbing separated gold before it can be collected.

Similarly, U.S. Pat. Nos. 4,265,743 and 4,347,130, both to Younge, describe rotating sluice boxes for removing gold or other relatively heavy particles from placer gravel. These devices rely on centrifugal force to force relatively heavy particles to be separated from waste materials. U.S. Pat. No. 4,071,143 to Richan teaches an apparatus with a rotatable conical cap, curving sides, and a vertically extending riffle through which flows an ore-water slurry to capture heavy metals and dispose of tailings. Currents of air are blown over sand containing gold to separate the gold in U.S. Pat. No. 4,642,180 to Kaufman.

Devices used for related purposes have also been developed. U.S. Pat. No. 7,168,568 to Wise describes a device for separating non-magnetic minerals from a source containing both magnetic and non-magnetic material. U.S. Pat. No. 3,761,132 to Grable teaches an apparatus for upwardly displacing soil by delivering fluid under pressure underground, with the potential auxiliary purpose of removing upwardly displaced precious metal particles.

While each of these devices is useful for its intended purpose, none enables a user to easily transport a machine to a site of sand or other ore naturally containing metals, which machine can be utilized to efficiently remove and retain heavy metals from significant quantities of sand.

SUMMARY AND OBJECTS OF THE INVENTION

A primary object of the present invention is to provide a method and apparatus for removing gold or other heavy metals from sand or other material in which the metals naturally occur. Although this description consistently refers to sand, it is understood that the mechanism and process will work with any granular or pulverized ore or other material in which heavy metals can be found.

Another object of the present invention is to provide such an apparatus which can be easily transported to sites of naturally occurring metals, so that the process can be accomplished at that site.

Yet another object of the present invention is to provide such an apparatus which efficiently processes large quantities of sand or other material, allowing metals to be removed and retained in a time period which is significantly less than achievable with known mechanisms.

These objects are achieved by a device consisting of a hollow tube with a closed end and an open end, the interior of which is arranged in spiral grooves, a hopper through which sand mixed with metals is funneled into the tube, a mechanism for rotating the tube, and a mechanism for delivering water into the open end of the tube. The device can be constructed so the end of the hollow tube that is open is higher than the end which is closed. Alternatively, a mechanism can be provided for raising the open end when in use, allowing the device to be lowered to a position more suitable for transporting in which the open end is at approximately the same height as the closed end.

The spiral grooves forming the interior wall of the hollow tube are arranged in helical fashion so that those grooves turn at an oblique angle as the tube is rotated. As a result, any material caught in those grooves is moved or screwed toward the open end of the tube as the tube is rotated. Because gold is typically heavier than the sand or other material in which the metal naturally occurs, as sand containing gold is washed and stirred within the tube, gravity keeps the sand and water mixture in the low end of the tube, while gold and other heavy metals settle into the grooves where they are screwed toward the open end. The remaining sand tends to form a mixture with water that can be discharged from an outlet such as a pipe inserted in the middle of the closed end of the tube.

The hopper may consist of any chute suitable for delivering sand mixed with metals into the tube. Ideally, the hopper channels sand through an aperture formed in the side of the tube. Although sand could be delivered into the tube through the open end either with or without a hopper, the hopper advantageously allows sand to be added to the tube through a separate side aperture, without disturbing metals which are being rotated toward the open end. Typically, sand will be shoveled into an open end of the hopper, which may be covered with a grate to block rocks or other large objects from entering the tube.

A specialized hopper may be efficiently used, consisting of a channel with an open input end for receiving sand mixed with metals and an opposite open output end which delivers that sand into a receptacle. The receptacle may advantageously surround the exterior of the tube in a manner that allows sand in the receptacle to be pushed through the aperture as the aperture rotates with the tube. In this manner, the receptacle holds the sand as the tube is rotated, introducing sand into the tube through the aperture when the aperture is rotated into contact with the sand and preventing the sand from escaping until it is pushed through the aperture.

A number of mechanisms may be used for rotating the tube. In a preferred embodiment of the present invention, one or more drive wheels may be arranged on a drive shaft, so that rotation of the drive shaft by a motor or engine causes the drive wheels to rotate. By placing each drive wheel in proximity to the exterior of the hollow tube, rotation of the drive wheel causes the tube to rotate in a direction opposite the rotation of the drive wheel. An auxiliary wheel or set of auxiliary wheels may beneficially be positioned on an opposite side of the tube, to provide additional rotational force. A set of pulleys and belts may be arranged to cause the auxiliary drive shaft to be rotated in the same direction as the main drive shaft as the main drive shaft is rotated.

Water may be introduced into the hollow tube to mix with the sand and metals mixture in a number of ways. For example, a hose or pipe may be connected to a water source at one end and positioned in the open end of the tube at the other end. The water source may conveniently be a pump pulling water from a stream or river, or a pump pulling water from a reservoir such as a barrel of water. Multiple water conduits may advantageously be used, one providing water to the sand and metals mixture at the lower, closed end of the tube, one providing water to a central area of the hollow tube to wash sand from metals, and a third providing a relatively smaller stream of water to the higher, open end of the tube, to wash the separated metals and direct those metals out of the tube into a receptacle.

The device can be conveniently mounted on a typical trailer for removably mounting on the ball of a trailer hitch, so that it can be carried to locations where sand and gold or other heavy metals may be found. The device can advantageously be stabilized by welding supports for the hollow tube onto the trailer frame.

Figure 1:
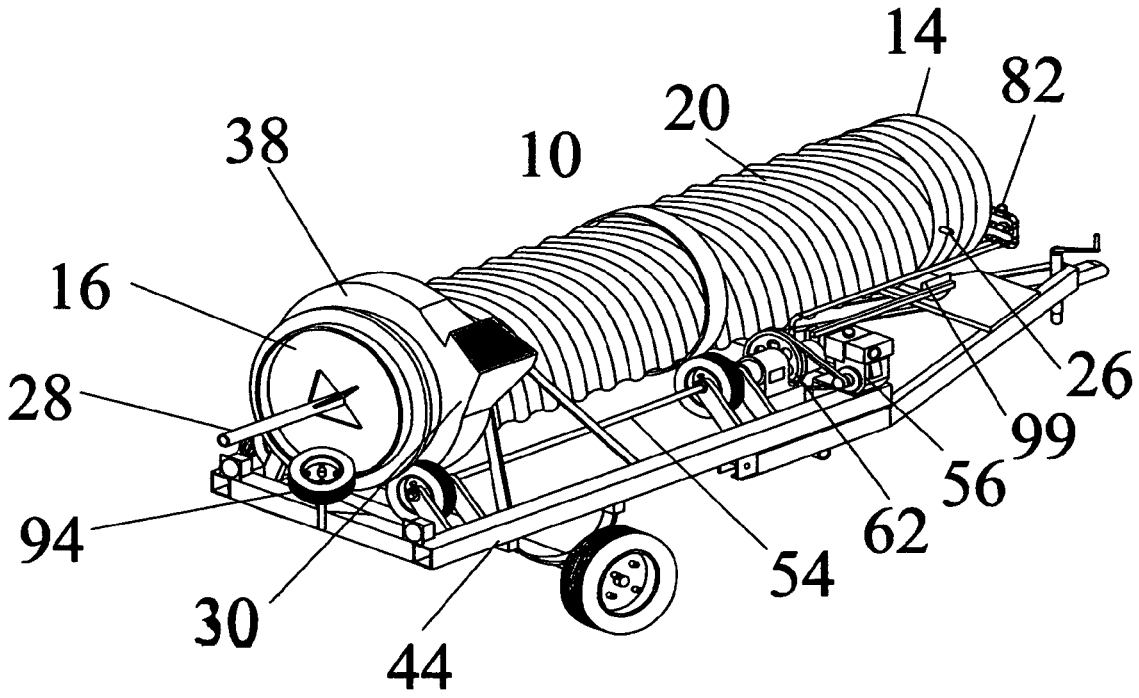
FIG. 1 is a perspective view of a device for removing heavy metals from sand, viewed from the closed end, according to the present invention.

In the drawings, the following legend has been used:

| | |
|---|---|
| 10 | Device for removing heavy metals from sand |
| 12 | Hollow tube |
| 14 | Open end of hollow tube |
| 16 | Closed end of hollow tube |
| 18 | Interior of hollow tube |
| 20 | Exterior of hollow tube |
| 22 | Spiral grooves in interior of hollow tube |
| 24 | Hole in tube through which sand is delivered into tube |
| 26 | Hole near open end of tube |
| 28 | Outlet for draining excess water and sand after processing |
| 30 | Hopper |
| 32 | Channel in hopper |
| 34 | Input end of channel |
| 36 | Output end of channel |
| 38 | Receptacle surrounding hollow tube |
| 40 | Grate covering input end of channel |
| 42 | Agitator |
| 44 | Mechanism for transporting tube |
| 50 | Mechanism for rotating tube |
| 52 | Drive wheels |
| 54 | Drive shaft |
| 56 | Motor connected to drive shaft |
| 58 | Auxiliary drive wheels |
| 60 | Auxiliary drive shaft |
| 62 | Drive shaft pulley |
| 64 | Auxiliary drive shaft pulley |
| 66 | Belts connecting pulleys |
| 70 | Mechanism for adding water to tube |
| 72 | Water hose from water source to pump |
| 74 | Water supply end of hose |
| 76 | Pump end of hose |
| 78 | Water pump |
| 80 | Water reservoir |
| 82 | Water control valve |
| 84 | Pipe from pump to pipes in tube |
| 86 | Pipe to open end of tube |
| 88 | Pipe to central area of tube |
| 89 | Pipe to lower end of tube |
| 90 | Scissors lift |
| 92 | Mechanism for lifting open end of tube |
| 94 | Support on which closed end of tube is supported |
| 95 | Metal |
| 96 | Sand mixed with metal |
| 97 | Sand |
| 98 | Water |
| 99 | Collection receptacle |

DESCRIPTION OF THE PREFERRED EMBODIMENT

The present invention concerns a method and apparatus for separating gold or other heavy metals from sand or other materials in which metals can be found. In the following description, numerous specific details are set forth in order to provide a thorough understanding of the present invention. It will be obvious, however, to one skilled in the art that the present invention may be practiced without these specific details. Some well-known methods and structures have not been set forth in order not to unnecessarily obscure the description of the present invention.

The ore separating device 10 claimed herein includes a hollow tube 12, a hopper 30 for funneling a sand and metal mixture 96 into the tube 12, a rotating mechanism 50 for rotating the tube 12, and a water delivery mechanism 70 for delivering water into the tube 12. The device 10 may advantageously be mounted on a trailer towed behind a vehicle or other transportation device 44, for ease in moving the device 10 to a location where sand mixed with metal 96 may be found.

Figure 2:
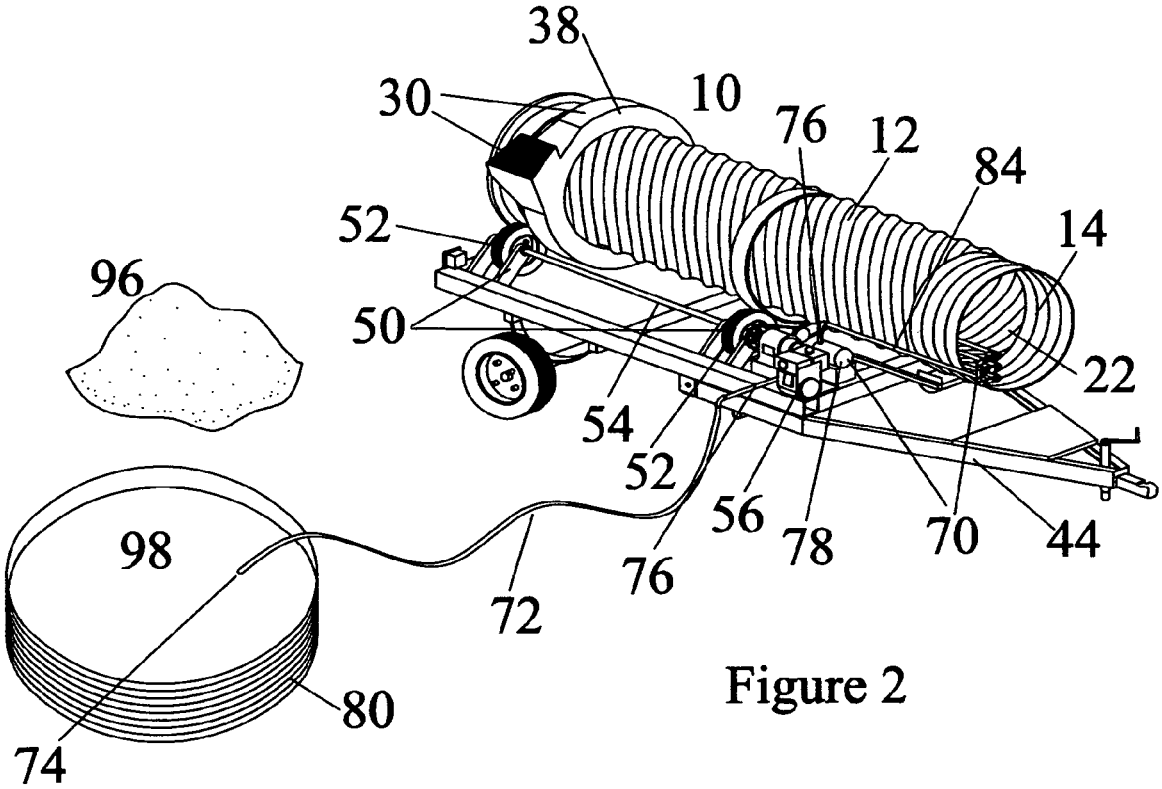
FIG. 2 is a perspective view of a device for removing heavy metals from sand, viewed from the open end, according to the present invention.
Figure 7:
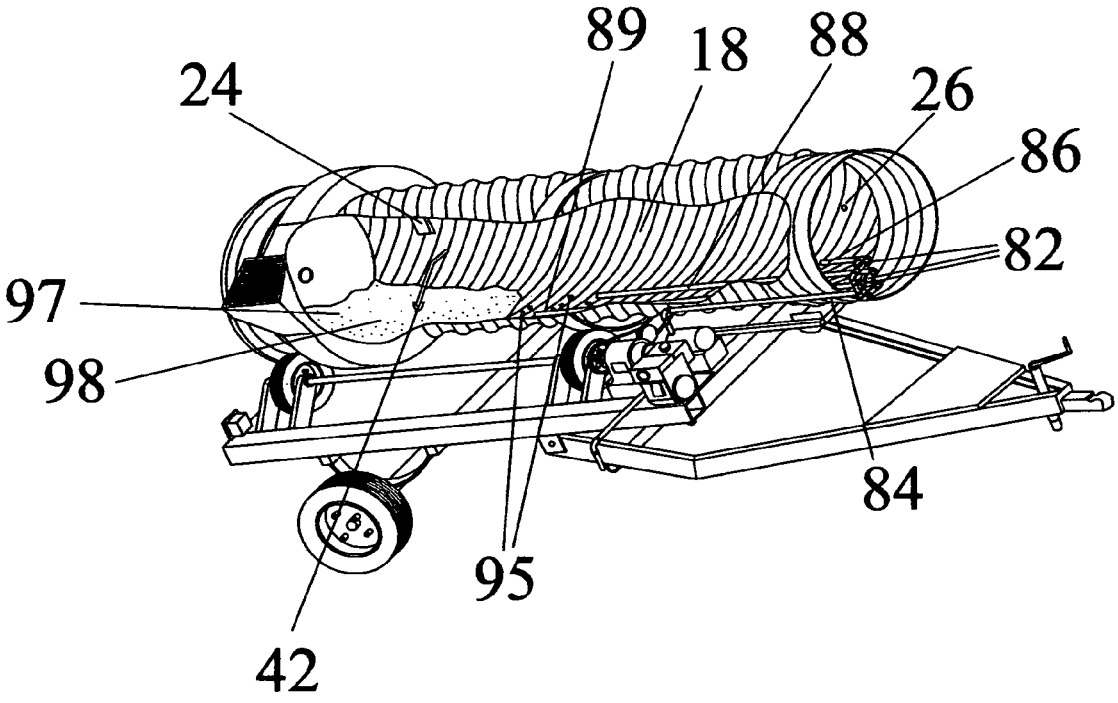
FIG. 7 is a cut-away view of the interior of a device according to the present invention.

As best shown in FIG. 1, the hollow tube 12 has an open end 14, a closed end 16, an exterior 20, and an interior 18. The interior 18 of the tube 12 is formed into spiral grooves 22, as shown in FIGS. 2 and 7. These spiral grooves 22 are arranged in a continuous strand in helical fashion so that the grooves 22 turn at an oblique angle as the tube 12 is rotated. The interior grooves 22 operate as a screw, moving any heavy metal 95 which has been caught in the grooves 22 toward the open end 14 of the tube 12.

Figure 5:
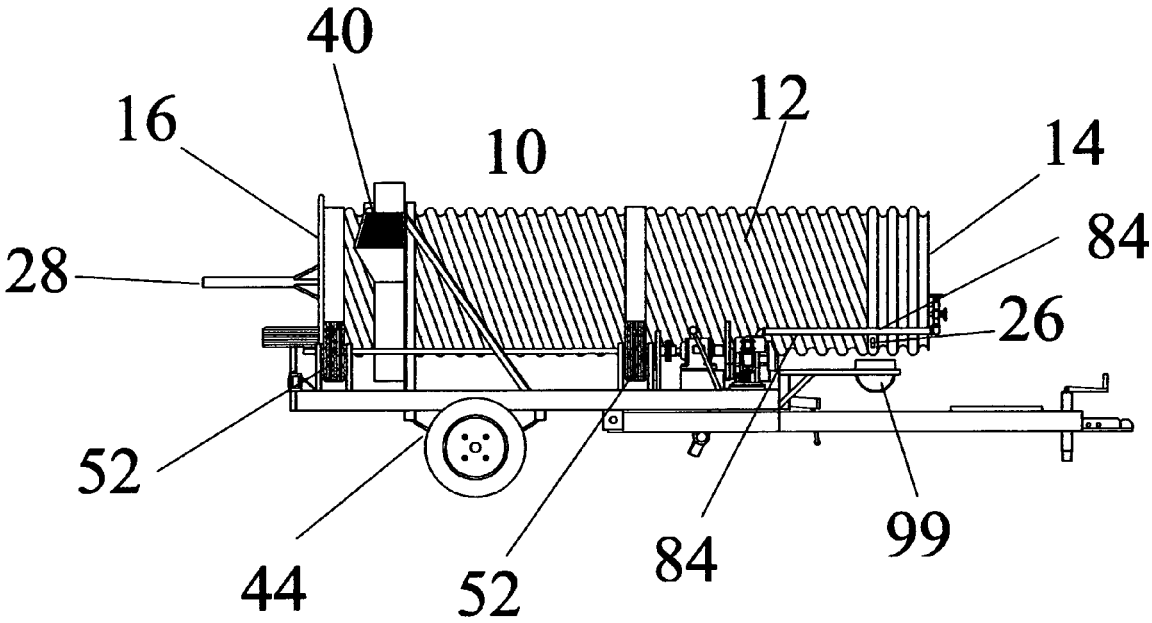
FIG. 5 is a side view of a device according to the present invention, in which the device has been lowered for ease of transport.
Figure 6:
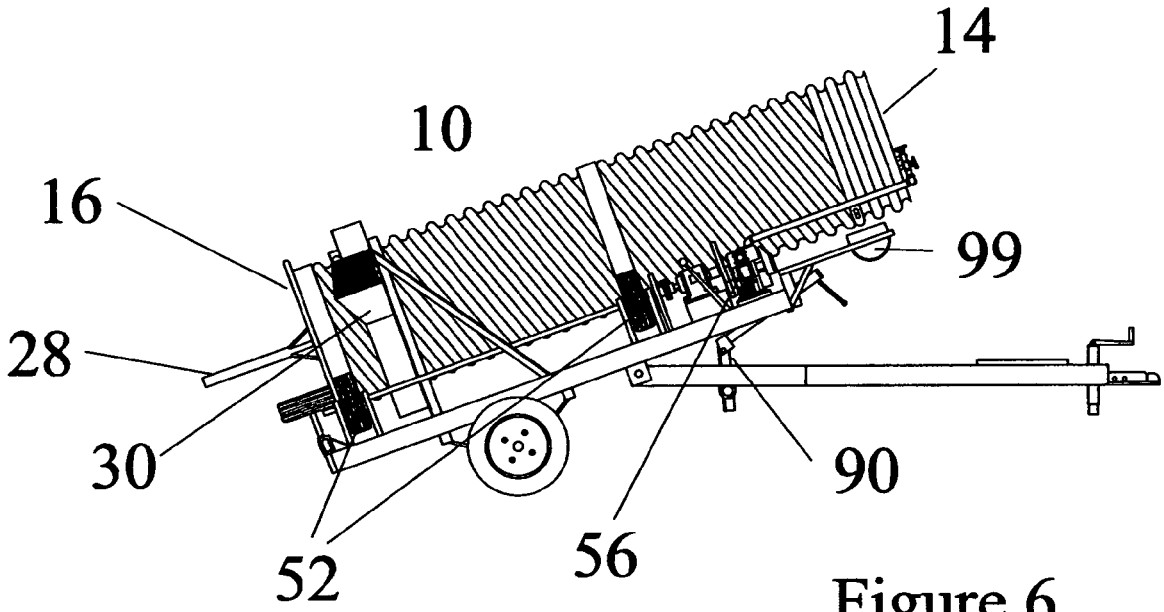
FIG. 6 is a side view of a device according to the present invention, in which the device has been raised for use.

The mechanism 10 works most efficiently when the open end 14 is positioned relatively higher than the closed end 16, as shown in FIG. 6. The device 10 may be constructed so the open end 14 is always higher than the closed end 16, or a lifting mechanism 92 may be used to maintain the open end 14 in a relatively higher position while the device 10 is in use. For ease in transporting the device 10, the lifting mechanism 92 may be utilized to lower the open end 14 to a height similar to that of the closed end 16 during transportation of the device 10, as shown in FIG. 5. The lifting mechanism 92 may conveniently consist of a scissors lift 90 positioned under the open end 14 of the tube 12 and a support 94 on which the closed end 16 of the tube is supported. The lifting mechanism 92 is most advantageously adjustable to allow the relative height of the open end 14 with respect to the closed end 16 to be adjusted during use of the mechanism 10 to keep water 98 and sand 97 at a most efficient level within the hollow tube 12. This most advantageous relative height can be determined by simply looking through the open end 14 into the hollow tube 12 to view the separation process, and thus a platform for viewing the process may conveniently be provided.

Although sand mixed with metal 96 may be introduced into the tube 12 through the open end 14, this would disturb the separation process. Therefore, it is beneficial to form a separate aperture 24 in the tube 12 relatively close to the closed end 16 through which the sand and metal mixture 96 may be delivered, as shown in FIG. 7. Use of a separate aperture 24 near the closed end 16 to introduce the sand and metal mixture 96 into the tube 12 avoids disturbing metal 95 which is being carried toward the open end 14 of the tube 12 by the rotating spiral grooves 22.

It may be advantageous to provide two additional apertures in the hollow tube 12. A hole 26 relatively near the open end 14 of the tube, as shown in FIG. 5, may be used to drain metals 95 from the tube as the metal 95 is screwed toward the open end 14 by the spiral grooves 22. A collection receptacle 99 may be positioned under the hole 26 so that separated heavy metals 95 drop from the tube 12 into the collection receptacle 99 when the tube 12 is rotated to a position in which the hole 26 is at the bottom of the tube 12. Also, as shown in FIG. 1, an outlet 28 formed in the closed end 16 may be utilized to drain from the tube 12 excess water 98 and sand 97 from which heavy metals 95 have been removed.

Figure 4:
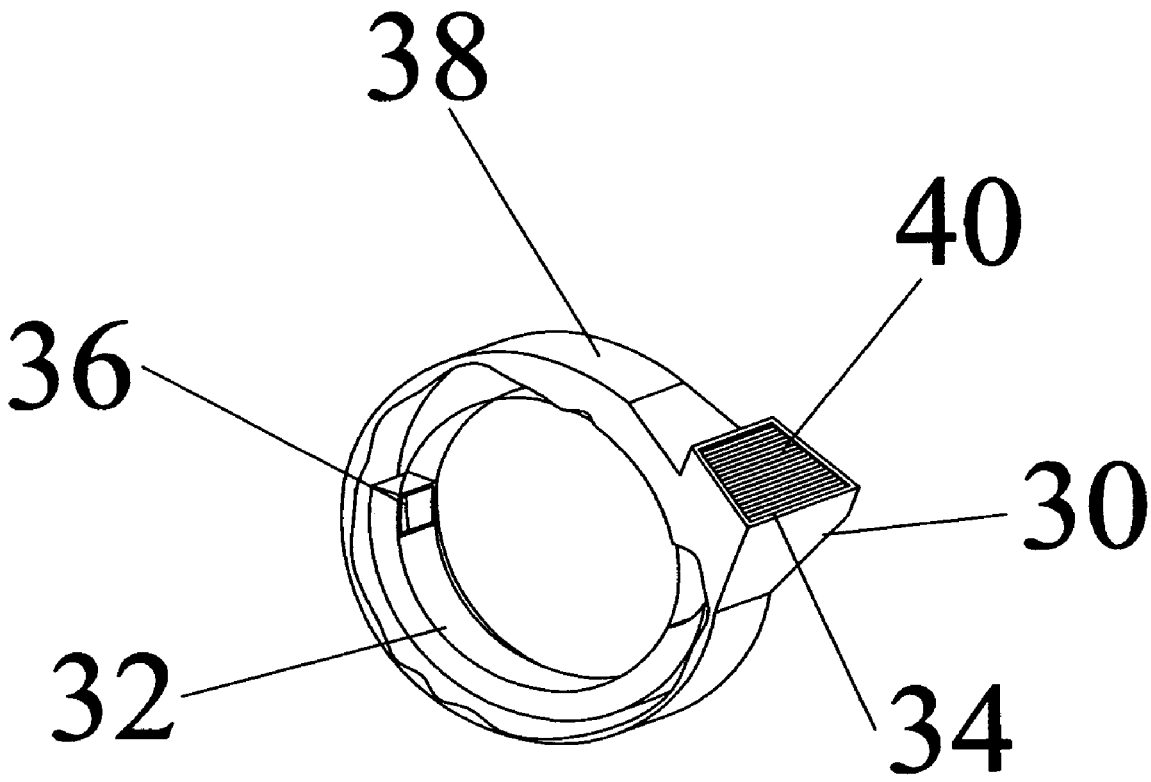
FIG. 4 is a cut-away view of the hopper used in a device for removing heavy metals from sand, according to the present invention.

As best seen in FIG. 4, the hopper 30 consists of a channel or chute 32 with an input end 34 and output end 36. A grate 40 may beneficially be used to cover the input end 34 of the hopper 30, to prevent large rocks and other debris from entering the hopper 30. In a preferred embodiment of the claimed invention, the hopper 30 includes a receptacle 38 circumferentially surrounding the hollow tube 12, which receives the sand and metals mixture 96 which has been shoveled or otherwise added into the hopper 30. By surrounding the tube 12 with the receptacle 38, the sand and metals mixture 96 which exits the output end 36 is held in close proximity to the tube 12, and pushed or dropped through the aperture 24 into the tube 12 when rotation of the tube 12 causes that aperture 24 to contact the sand and metals mixture 96. It would be possible to use a receptacle 38 which did not completely surround the tube 12, but formed a semi-circle shaped (not shown) reservoir of sand and metals 96 underneath and along the sides of the tube 12, without also covering the top of the tube 12. However, a surrounding receptacle 38 also advantageously serves the purpose of safely preventing the sand and metals mixture 96 from exiting the hopper 30 and dropping on the ground or hitting a person or thing located near the tube 12. As best shown in FIG. 4, the output end 36 of the hopper 30 is beneficially positioned above the anticipated level of the mixture of water 98, sand and metal 96 in the tube 12, so that mixture will not leak out of the tube 12 through the output end 36 even if rotation of the tube 12 is stopped with the aperture 24 in a downward position.

Rotation of the tube 12 creates a rolling action that agitates a mixture of water 98, sand 97, and heavy metals 95, causing the relatively heavy metals 95 such as gold to separate from the sand and metals mixture 96. Further agitation may be accomplished mechanically by using an agitator 42, as shown in FIG. 7. As the relatively heavy metals 95 are separated and fall to the bottom of the material 96, 98 in the tube 12, the metals 95 are caught in the spiral grooves 22. Rotation of the tube 12 turns the spiral grooves 22 in a screw fashion, causing the heavy metals 95 caught in those grooves 22 to be carried toward the open end 14 of the tube 12, as shown in FIG. 7.

Figure 3:
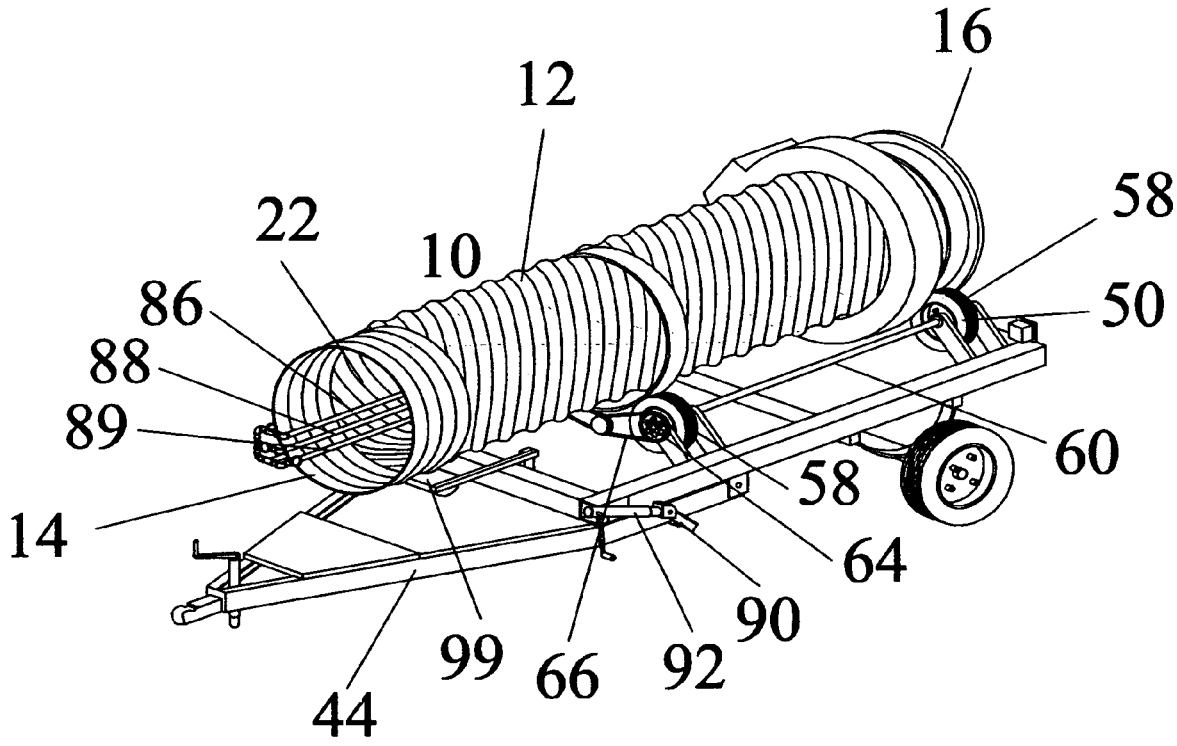
FIG. 3 is a perspective view of a device for removing heavy metals from sand, viewed from the open end along a side opposite of that shown in FIG. 2, according to the present invention.

Although a number of mechanisms known in the prior art would be effective for rotating the tube, in a preferred embodiment of the claimed invention best shown in FIG. 2, the rotation mechanism 50 consists of one or more drive wheels 52 aligned on a drive shaft 54 adjacent to the exterior 20 of the hollow tube 12. The drive shaft 54, and thus the drive wheels 52 aligned along it, are rotated by an engine or motor 56. Because the drive wheels 52 are adjacent to the tube 12, rotation of the drive wheels 52 pushes the tube 12 so that it rotates in an opposite direction. Additional rotational force may be achieved by aligning one or more auxiliary drive wheels 58 on an auxiliary drive shaft 60, adjacent to the opposite side of the hollow tube 12, as shown in FIG. 3. The auxiliary drive shaft 60 may be connected to the drive shaft 54 by a system of pulleys 62, 64 and belts 66, allowing the same engine or motor 56 to rotate both sets of wheels 52, 58.

One of the advantages of the claimed invention is that it is easily transportable to any location reachable by a vehicle with a trailer hitch, so that gold or other heavy metals may be removed from sand at a location where those materials naturally occur. In this manner, metals extraction can be efficiently achieved, without the costs associated with transporting heavy batches of sand mixed with metals to a remote processing plant. Because the claimed apparatus requires water 98 to properly operate, a source of water must be provided in the location where the sand 97 and metals 95 are found. This can be accomplished in a number of ways. For example, if the site of the sand and metals mixture 96 is near a stream, water can be pumped from the stream into the device 10. If naturally occurring water 98 is not available, barrels or other containers of water (not shown) may be transported with the device 10, from which water 98 is pumped into the tube 12 during the separation process. Water 98 exiting the tube 12 through the outlet 28 may be captured in a container (not shown) from which water 98 can be pumped for further use. A relatively small amount of water 98 is necessary to complete the separation process, compared to most devices currently used for separating ore.

In a preferred embodiment shown in FIG. 2, the water delivery mechanism 70 consists of at least one water hose 72 with a water supply end 74 positioned in a reservoir 80 and a pump end 76 attached to a pump 78. The pump 78 draws water from the reservoir 80 through the hose 72, and pushes that water through a pipe 84 toward the tube 12. The pipe 84 may conveniently be connected to a series of pipes 86, 88, 89, each of which delivers water 98 into the interior 18 of the tube 12, as best shown in FIG. 7. A control valve 82 on each pipe 86, 88, 89 allows an operator to control the flow of water 98 through each pipe 86, 88, 89. Ideally, pipe 89 ends near the lower, closed end 16 of the tube 12, so as to deliver water 98 to the sand and metal mixture 96 at the lower end of the tube 12. Although water 98 is initially delivered into the sand and metals mixture 96 near the closed end 16, typically the flow of water from pipe 89 can be discontinued during the separation process, unless the sand and metals mixture 96 is particularly dry and in need of continued water 98 to remain fluid. Adding water 98 to the sand and metals mixture 96 creates a slurry of materials 95, 97, 98 in the lower end of the tube 12. The control valve 82 connected to pipe 88 is used by the operator to control the flow of water 98 through pipe 88 into a relatively central area of the interior of the tube 18, where that water 98 is used to wash sand 97 back into the closed end 16 of the tube 12, facilitating the separation of sand 97 from metals 95. The amount of water 98 flowing through pipe 88 should be regulated carefully to cause as much sand 97 and as little metals 95 as possible to wash back into the closed end 16 of the tube 12. Thus, the operator (not shown) will want to observe the separation process through the open end 14, and regulate the water flow with the control valve 82 on pipe 88. The control valve 82 on pipe 86 is used to cause a relatively gentle stream of water 98 to be delivered through pipe 86 to an area near the open end 14 of the tube 12. This relatively small stream of water 98 washes the heavy metals 95 which have been carried by the spiral grooves 22 to the open end 14, and facilitates moving those metals 95 through the opening 26 into a collection receptacle 99. Thus, while all three pipes 86, 88, 89 are connected at one end to the pipe 84 through which the pump 78 delivers water 98, pipe 89 is inserted through the open end 14 and extends to an area close to the closed end 16, pipe 88 is inserted through the open end 14 and extends to an area relatively central to the interior 18 of the tube 12, and pipe 86 is inserted through the open end 14 and extends to an area near the open end 14.

Thus, the present invention provides a method of efficiently separating gold and other heavy metals from sand in which those metals are naturally present, allowing relatively large quantities of sand to be processed quickly. Because the claimed device is easily transportable, processing may occur in a location near where the heavy metals are naturally deposited. Although the present invention has been described in terms of the presently preferred embodiment, it is to be understood that such disclosure is purely illustrative and is not to be interpreted as limiting. Consequently, without departing from the spirit and scope of the invention, various alterations, modifications, or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A device for removing metals from sand, comprising:

a. Hollow tube with opposing open end and closed end, an interior and an exterior, said open end positioned at a desired height above said closed end, said interior having spiral grooves, b. Hopper for funneling sand mixed with metal into said hollow tube through an aperture formed in said hollow tube in proximity to said closed end, and wherein said hopper further comprises a receptacle, wherein said receptacle engages said exterior of said tube, c. Rotating means for rotating said hollow tube, and d. Water means for delivering water into said hollow tube, e. wherein said spiral grooves are arranged in helical fashion so that said grooves turn at an oblique angle as the tube is rotated, said grooves separating relatively heavy elements of said sand mixed with metal from less heavy elements of said sand mixed with metal as relatively heavy elements settle into said grooves.

2. A device for removing metals from sand, comprising:

a. Hollow tube with opposing open end and closed end, an interior and an exterior, said open end positioned at a desired height above said closed end, said interior having spiral grooves, b. Hopper for funneling sand mixed with metal into said hollow tube wherein said hopper further comprises:

i. a channel having an open input end and an opposite open output end, said input end suitable for receiving sand mixed with metal and said output end emptying into a receptacle, ii. wherein said receptacle engages said exterior of said tube so that sand mixed with metal in said receptacle is delivered through an aperture formed in the exterior of said hollow tube into said interior of said tube, and iii. wherein said receptacle circumferentially surrounds said exterior of said tube in proximity to said aperture in said hollow tube, c. Rotating means for rotating said hollow tube, and d. Water means for delivering water into said hollow tube.

3. A device for removing metals from sand, comprising:

a. Hollow tube with opposing open end and closed end, an interior and an exterior, said open end positioned at a desired height above said closed end, said interior having spiral grooves, b. Hopper for funneling sand mixed with metal into said hollow tube, c. Rotating means for rotating said hollow tube, wherein said rotating means comprises:

i. at least one drive wheel positioned adjacent to said tube so that rotation of said drive wheel causes said tube to rotate, ii. drive shaft substantially parallel to said tube forming an axle for said drive wheel so that rotation of said drive shaft causes said drive wheel to rotate, iii. drive means for rotating said drive shaft comprising an engine engaged with said drive shaft, iv. at least one auxiliary wheel positioned adjacent to an opposite side of said tube from said drive wheel, v. an auxiliary drive shaft substantially parallel to said tube forming an axle for said auxiliary wheel so that rotation of said auxiliary drive shaft causes said auxiliary wheel to rotate, vi. drive shaft pulley surrounding and rotated with drive shaft, vii. auxiliary drive shaft pulley surrounding and rotated with auxiliary drive shaft, viii. double grooved pulley, and ix. belt in tight engagement with and riding around said drive shaft pulley and said double grooved pulley, and second belt in tight engagement with said auxiliary drive shaft pulley and said double grooved pulley, so that rotation of said drive shaft pulley causes said auxiliary drive shaft pulley to rotate, and d. Water means for delivering water into said hollow tube.

4. A device for removing metals from sand, comprising:

a. Hollow tube with opposing open end and closed end, an interior and an exterior, said open end positioned at a desired height above said closed end, said interior having spiral grooves, b. Hopper for funneling sand mixed with metal into said hollow tube, c. Rotating means for rotating said hollow tube, and d. Water means for delivering water into said hollow tube, comprising:

i. water source, ii. main water conduit with opposing open ends, having one end connected to said water source and having an opposite end connected to a pump, which pump pulls water from the water source, iii. second water conduit with opposing open ends, having one end connected to said pump and having an opposite end positioned to deliver water into said hollow tube, iv. a main pipe inserted through said open end of said hollow tube, connected at one end to said second water conduit and with an opposite end positioned to deliver water to a relatively central area of said hollow tube, v. a secondary pipe inserted through said open end of said hollow tube, connected at one end to said second water conduit and with an opposite end positioned to deliver water relatively close to said open end of said hollow tube so that metal collecting near said open end of said tube is moved through an aperture formed in said tube in proximity to said open end of said tube to exit said tube, and vi. valve controls to regulate water flowing through each pipe.

5. A device according to claim 4, wherein said water means further comprises:

a. a third pipe inserted through said open end of said hollow tube, connected at one end to said second water conduit and with an opposite end positioned to deliver water relatively close to said closed end of said hollow tube, and b. valve control to regulate water flowing through said third pipe.

* * * * *